US005083996A

United States Patent [19]

Smith

[11] Patent Number: 5,083,996

[45] Date of Patent: Jan. 28, 1992

[54] METHOD FOR MANUFACTURING PALLET ASSEMBLY

[75] Inventor: Daniel A. Smith, Valparaiso, Ind.

[73] Assignee: Gate Pallet Systems, Inc., Valparaiso, Ind.

[21] Appl. No.: 625,916

[22] Filed: Dec. 11, 1990

Related U.S. Application Data

[62] Division of Ser. No. 524,653, Jul. 17, 1990, Pat. No. 5,001,991.

[51] Int. Cl.[5] ..... B31B 17/14; B31B 17/74

[52] U.S. Cl. ..... 493/344; 29/453; 493/350; 493/379; 493/964

[58] Field of Search ..... 29/453; 493/343, 344, 493/350, 379, 964

[56] References Cited

U.S. PATENT DOCUMENTS

| | | | |
|---|---|---|---|
| 2,728,545 | 12/1955 | Hermitage | 248/120 |
| 2,955,791 | 2/1957 | George | 248/120 |
| 3,016,562 | 1/1962 | Reid | 29/453 |
| 3,058,709 | 10/1962 | Van Moss, Jr. et al. | 248/120 |
| 3,683,822 | 8/1972 | Roberts et al. | 108/56 |
| 4,563,377 | 1/1986 | Melli | 428/36 |
| 4,792,325 | 12/1988 | Schmidtke | 493/334 |
| 4,802,421 | 2/1989 | Atterby et al. | 108/51.1 |
| 4,834,001 | 5/1989 | Atterby | 108/51.3 |
| 4,841,880 | 6/1989 | Ferguson | 108/51.1 |
| 4,867,074 | 9/1989 | Quasnick | 108/51.3 |

FOREIGN PATENT DOCUMENTS

| | | |
|---|---|---|
| 996516 | 6/1965 | United Kingdom . |
| 1134601 | 11/1968 | United Kingdom . |

*Primary Examiner*—Bruce M. Kisliuk
*Assistant Examiner*—Jack Lavinder
*Attorney, Agent, or Firm*—Dressler, Goldsmith, Shore, Sutker & Milnamow, Ltd.

[57] ABSTRACT

A disposable pallet assembly includes cylindrical reinforcing pieces which are engaged with the stringer members along bottom side portions thereof.

3 Claims, 2 Drawing Sheets

METHOD FOR MANUFACTURING PALLET ASSEMBLY

This application is a division of application Ser. No. 07/524,653, filed July 17, 1990 now U.S. Pat. No. 5,001,991.

TECHNICAL FIELD OF THE INVENTION

This invention pertains generally to pallets and particularly to an improved pallet assembly made predominantly of corrugated paper and with one or more reinforced stringers.

BACKGROUND OF THE INVENTION

Disposable pallets made of corrugated paper are known in the art and have been commercially available for a number of years. Such pallets are disclosed, for example, in U.S. Pat. No. 2,728,545, issued to Hermitage on Dec. 27, 1955; U.S. Pat. No. 3,683,822, issued to Roberts et al. on Aug. 15, 1972; and U.S. Pat. No. 4,831,938, issued to Atterby et al. on May 23, 1989. Schmidtke U.S. Pat. No. 4,792,325, issued on Dec. 20, 1988, provides a method and machine for making a cardboard pallet. A particularly desirable form of corrugated construction pallet, and a method for manufacturing the same, are disclosed in Quasnick U.S. Pat. No. 4,867,074, issued Sept. 19, 1989.

To be satisfactory for their intended purposes, it is of course necessary that any such pallet exhibit an advantageous strength-to-weight ratio, and also that it be capable of withstanding considerable abuse, particularly under conditions that would typically be encountered during commercial shipment of a load thereupon. While prior art structures of this kind have been found to be generally satisfactory, one area of notable deficiency has resided in the levels of lateral stability that they afford; specifically, the load carried by a pallet tends to shift in transit, or at least to impose forces thereupon that are of varying magnitude and direction. Pallets that do not offer adequate lateral stability will tend to fail, with the likelihood thereof depending of course upon the mass of the load, the conditions to which it is subjected in transit, time factors, etc. The above-identified Quasnick patent substantially advances the art in these regards, but it goes without saying that the realization of still further improvements would be highly desirable.

SUMMARY OF THE INVENTION

According to this invention, an improved pallet assembly comprises a plurality of elongated stringer members, each being fabricated from multiple plies of web material, and a multiplicity of elongated decking members traversing the stringer members and assembled with them adjacent the top side of the pallet assembly. At least one of the stringer members has upwardly and transversely extending indentations, to define a neck portion at the bottom side thereof. A hollow, tubular reinforcing piece is inserted upwardly into the indentations of an associated stringer member, with the neck portion thereof extending downwardly thereinto, so that the components are securely and tightly interengaged with one another.

In the preferred embodiments opposite sidewall portions of each of the reinforcing pieces will be axially and transversely slotted so as to engage portions of the associated stringer lying upwardly of its neck portion. The reinforcing pieces will most advantageously be cylindrical, and the stringer members and reinforcing pieces will all have bottom surfaces that are disposed on a common plane, or at least substantially so. Generally, the stringer members and the reinforcing pieces will be frictionally interengaged, with the pallet assembly being devoid of adhesives and mechanical fasteners securing those components together.

The plies of web material of which the stringer members are comprised will normally be oriented substantially parallel to the axis of the associated reinforcing piece. Both the stringer members and also the decking members will usually be of one-piece, corrugated paper construction, and most desirably the reinforcing pieces will be made of paper as well. Tightly wound paper tubing, such as that used for cores for paper rolls, is a suitable material for such pieces.

Other objects of the invention are attained by the provision of a method for manufacturing a reinforced pallet assembly constructed as hereinabove set forth. The steps constituting the improvement thereof include the formation of upwardly and transversely extending indentations in at least one of the stringer members, preferably in each of a plurality of the stringer members, and the insertion of a hollow tubular reinforcing piece thereinto so as to effect secure and tight interengagement of the parts, with the neck portion of the stringer member extending downwardly into the bore of the reinforcing piece.

The method will preferably include an additional step in which opposite sidewall portions of each reinforcing piece are axially and transversely slotted before assembly with the associated stringer member. Most desirably, interengagement between the components will be effected by frictional means alone.

DETAILED DESCRIPTION OF THE ILLUSTRATED EMBODIMENT

Figure 4:
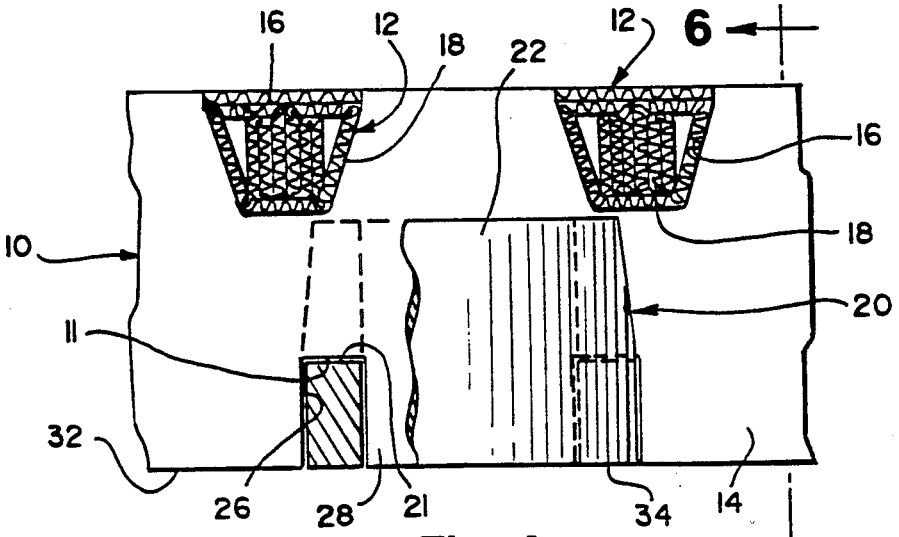
FIG. 4 is a fragmentary side elevational view of the pallet assembly of FIG. 1, shown in partial section and drawn to the scale of FIGS. 2 and 3.
Figure 5:
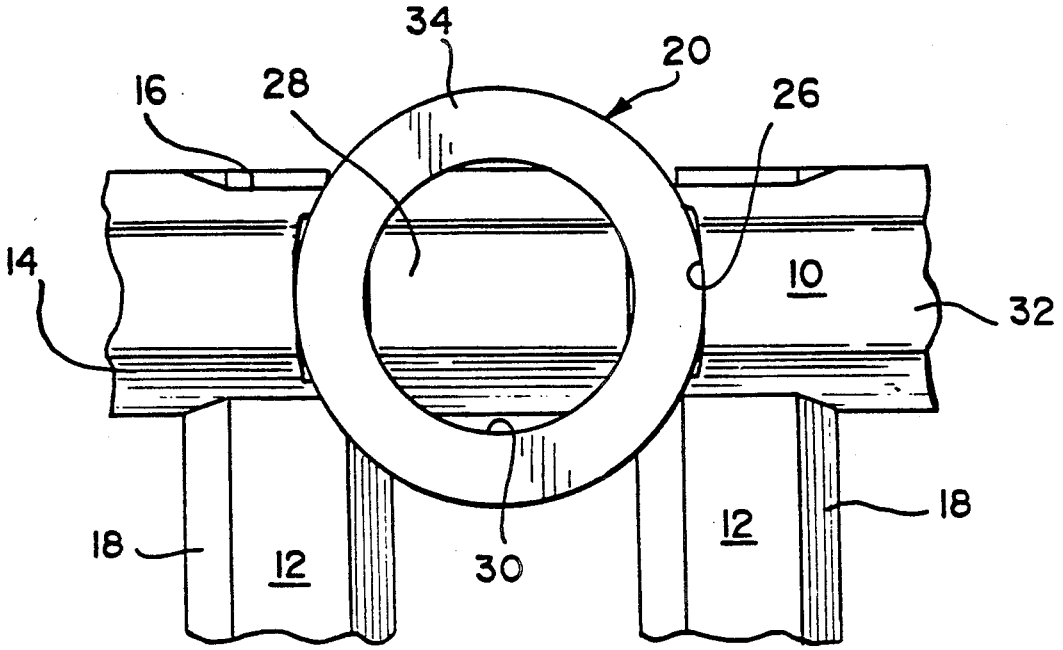
FIG. 5 is a fragmentary bottom view of the pallet assembly.
Figure 6:
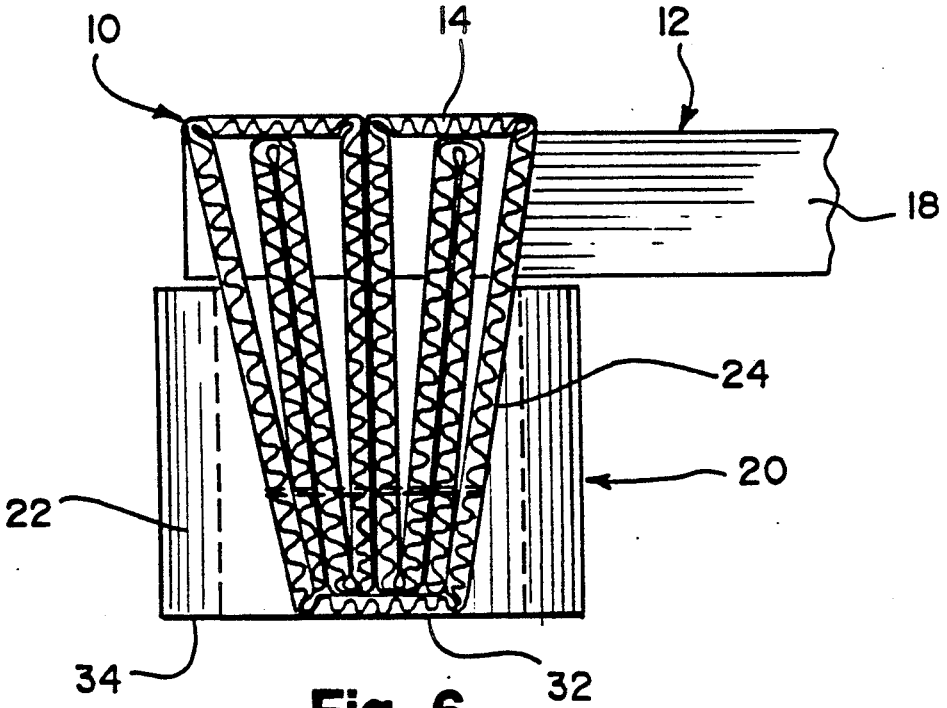
FIG. 6 is a vertical sectional view of the assembly, taken along lines 6—6 of FIG. 4.

Turning now in detail to the appended drawings, therein illustrated is a pallet assembly embodying the present invention and consisting of three stringer members, generally designated by the numeral 10, and four transversely extending decking members 12, assembled therewith. As can best be seen from FIGS. 4–6, the stringer and decking members are fabricated from single pieces of multiple-ply web material (e.g., 275 pound, C-flute corrugated paper) folded to provide elongated structures of generally trapezoidal cross-section, symmetrical about their vertical, longitudinal center lines. These components are similar to those that are described more fully in the above-identified Quasnick U.S. Pat. No. 4,867,074, albeit that (as substantiated by the illustrated embodiment hereof) the improved stringer construction described therein need not necessarily be employed in the instant assembly. As can be seen, each stringer member 10 is formed with four transverse passages 16 at a level proximate the top side of the pallet assembly, to accommodate and tightly engage the decking members 12.

Tubular reinforcing pieces, generally designated by the numeral 20, are assembled with the stringer members 10. Tightly wound paper tubing, such as that used for cores for paper rolls, is a suitable material for the pieces 20. Another dense, rigid and strong material may be alternatively used. Each piece 20 consists of a cylindrical sidewall 22, which defines an axis, and opposite portions of which are slotted axially and transversely, as at 24. The bottom side portion of each stringer member 10 is correspondingly indented inwardly and transversely, as at 26, creating a short neck portion 28 therebetween. The reinforcing piece 20 is assembled with the associated stringer member 10 by inserting the neck portion 28 into the bore 30 thereof, ultimately bringing the corresponding shoulder surface 11 and 21 thereon into abutment to thereby firmly seat the reinforcing piece upon the stringer member. It will be noted that in the fully inserted condition the bottom surfaces 32 and 34 of the stringer members and reinforcing pieces, respectively, are disposed on a common, normally horizontal plane. It will also be noted that the reinforcing pieces 20 are held tightly and securely in place merely by frictional force, without use of any adhesive or fastener, albeit that such supplemental means, or mechanically interlocking elements, may be employed if so desired.

Although the preferred form of stringer members, decking members and reinforcing pieces are illustrated, it will be appreciated that each such component may take any of a variety of different configurations and constructions without departing from the scope of the instant invention. For example, virtually any of the structures described in the above-identified prior art patents may be employed in the practices hereof. It is important, however, that sidewall elements of the reinforcing pieces extend along the outer surfaces of the stringer members with which they are associated; they provide lateral support and assistance in maintaining the integrity of the stringer member, thus contributing significantly to the ability of the assembly to withstand lateral forces and shifting load conditions, and thereby helping to minimize damage and the likelihood of premature failure of the pallet.

Figure 1:
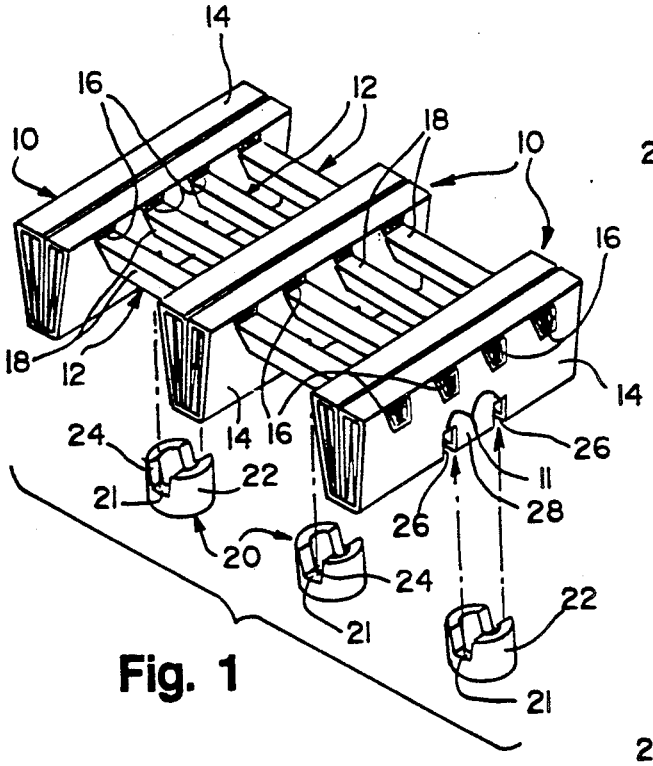
FIG. 1 is an exploded perspective view of a pallet assembly embodying the present invention.
Figure 2:
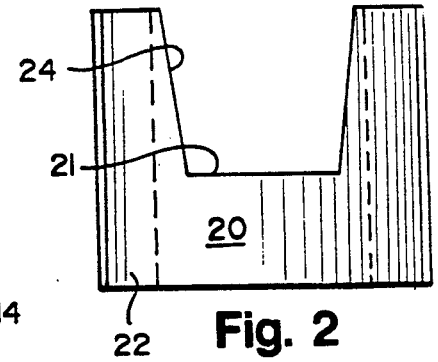
FIG. 2 is an elevational view of a cylindrical reinforcing piece utilized in the assembly of FIG. 1, drawn to an enlarged scale.
Figure 3:
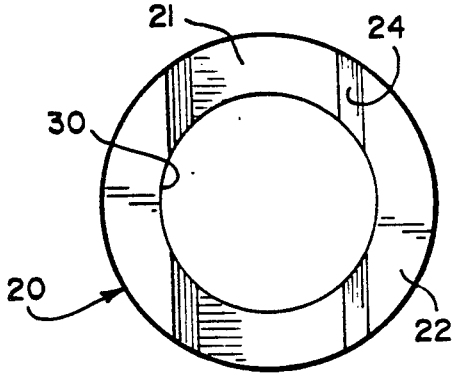
FIG. 3 is a plan view of the reinforcing piece of FIG. 2.

It will be appreciated that the pallet assembly shown in FIG. 1 is merely exemplary, and that in many instances a greater (or perhaps lesser) number of stringer members and decking members will be employed, depending primarily upon load factors and the surface area that is to be presented on the top side of the pallet. For example, the assembly may utilize ten decking members and three stringer members, to provide a supporting surface area measuring 48 × 40 inches, as is conventional. Furthermore, the number and arrangement of reinforcing pieces may vary from that illustrated, and typically three, six or nine of them will be employed. Needless to say, each stringer member may carry more than a single reinforcing piece, such as, for example, by providing one closer to each opposite end rather than in a centralized location, as illustrated. Also, it is possible to omit such reinforcing pieces from selected stringer members, such as the middle stringer member of the illustrated pallet. Finally, although paper will normally constitute the preferred material of construction of all components of the assembly, to afford optimal recycle characteristics and other benefits, plastic and other materials may be substituted in appropriate circumstances.

Thus, it can be seen that the present invention provides a novel disposable pallet assembly, made (except for the reinforcing pieces) of corrugated paper or like material, which exhibits an advantageous strength-to-weight ratio coupled with a high degree of lateral stability and resistance to collapse under shifting load conditions. The invention also provides a novel method for producing such a pallet assembly (usually corrugated for the stringer and decking members, and of a dense, rigid and strong form for the reinforcing pieces), and the method and assembly hereof are highly advantageous from the standpoints of simplicity, cost and production facility.

I claim:

1. In a method for manufacturing a reinforced pallet assembly, including the steps of fabricating a plurality of elongated stringer members having multiple plies of web material, fabricating a multiplicity of elongated decking members, and assembling said members in such manner that said decking members traverse said stringer members adjacent the top side of said pallet assembly, the improvement wherein said method includes the additional steps of forming upwardly and transversely extending indentations in each of a plurality of said stringer members to define a neck portion at the bottom side thereof, and inserting a hollow tubular reinforcing piece upwardly into said indentations of an associated one of said stringer members with said neck portion thereof extending downwardly thereinto, so as to effect secure and tight interengagement therebetween.

2. The method of claim 1 including the additional step of axially and transversely slotting opposite sidewall portions of each of said reinforcing pieces so as to effect engagement, within the slots formed, of portions of said associated stringer member disposed upwardly of said neck portion thereof.

3. The method of claim 1 wherein said pallet assembly is devoid of adhesives and fasteners securing said reinforcing pieces to said stringer members, assembly thereof being effected solely by frictional interengagement.

* * * * *